US010357975B2

(12) United States Patent
Namba

(10) Patent No.: US 10,357,975 B2
(45) Date of Patent: Jul. 23, 2019

(54) LIQUID EJECTION APPARATUS

(71) Applicant: BROTHER KOGYO KABUSHIKI KAISHA, Nagoya-shi, Aichi-ken (JP)

(72) Inventor: Mamoru Namba, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/916,434

(22) Filed: Mar. 9, 2018

(65) Prior Publication Data

US 2018/0264833 A1 Sep. 20, 2018

(30) Foreign Application Priority Data

Mar. 16, 2017 (JP) ..... 2017-051052

(51) Int. Cl.

*B41J 2/175* (2006.01)
*B41J 29/13* (2006.01)
*B41J 29/02* (2006.01)

(52) U.S. Cl.

CPC ..... *B41J 2/17523* (2013.01); *B41J 2/17509* (2013.01); *B41J 2/17513* (2013.01); *B41J 2/17553* (2013.01); *B41J 29/13* (2013.01); *B41J 29/02* (2013.01)

(58) Field of Classification Search

CPC ..... B41J 2/17523; B41J 2/17513; B41J 2/17553; B41J 29/02; B41J 29/13; B41J 2/17509

See application file for complete search history.

(56) References Cited

U.S. PATENT DOCUMENTS 9,049,329 B2 * 6/2015 Sasaki ..... B41J 3/44
9,994,013 B2 * 6/2018 Nakazawa ..... B41J 2/175
2014/0043408 A1 2/2014 Kudo et al.

FOREIGN PATENT DOCUMENTS

JP 2014-054825 A 3/2014

* cited by examiner

*Primary Examiner* — Thinh H Nguyen

(74) *Attorney, Agent, or Firm* — Merchant & Gould P.C.

(57) ABSTRACT

A liquid ejection apparatus, including: a liquid ejector; a housing including a tank storage portion in which is stored a tank for accommodating a liquid to be supplied to the ejector, the housing having an opening through which the tank storage portion and an exterior of the housing communicate; a lid attached to the housing and configured to be selectively positioned at one of a closed position at which the opening is closed and an open position at which the opening is opened; and an operation panel including an operating portion which is provided for at least one of front and upper surfaces of the housing and which is to be externally operated, wherein the lid is attached to the housing so as to be slidable in an up-down direction with respect to the housing, the lid being positioned at the open position by sliding upward from the closed position.

10 Claims, 10 Drawing Sheets

LIQUID EJECTION APPARATUS

CROSS REFERENCE TO RELATED APPLICATION

The present application claims priority from Japanese Patent Application No. 2017-051052, which was filed on Mar. 16, 2017, the disclosure of which is herein incorporated by reference in its entirety.

BACKGROUND

Technical Field

The following disclosure relates to a liquid ejection apparatus including an ejector and a housing which includes a tank storage portion in which is stored a tank for accommodating a liquid to be supplied to the ejector.

Description of Related Art

There is known a configuration in which a tank unit (tank storage portion) is provided at a right side surface of an apparatus body (housing) of a liquid ejection apparatus.

SUMMARY

In the disclosed configuration, the liquid ejection apparatus inevitably has an increased size in the right-left direction, giving rise to a problem in terms of a space occupied by the liquid ejection apparatus for installation. In general, a working space for a user is provided on a front side of the liquid ejection apparatus. Instead of providing the tank storage portion at the side of the housing, it is considered that the tank storage portion is configured to protrude toward a front side of the housing so as to be formed as a protruding portion, for solving the problem of the installation space.

Even in the configuration in which the tank storage portion is formed so as to protrude toward the front side, however, a lid for closing an opening through which the tank storage portion and an exterior of the housing communicate is attached to the housing so as to be slidable in the right-left direction. Accordingly, the lid protrudes from the housing in the right-left direction when the lid slides. In this case, it is needed to provide a space in the right-left direction of the liquid ejection apparatus, and the problem of the installation space described above remains unsolved.

Further, in a case where the lid is pivotably attached to the housing in the configuration in which the tank storage portion is formed so as to protrude toward the front side, it is needed to provide a space on the front side of the liquid ejection apparatus for allowing a pivotal movement of the lid. Further, if the user comes into contact with the lid in an open state, the lid may be damaged or the housing may topple over toward the front side.

Accordingly, an aspect of the present disclosure relates to a liquid ejection apparatus which is not likely to suffer from a damage to the lid and toppling of the housing while avoiding the problem of the installation space of the apparatus.

In one aspect of the disclosure, a liquid ejection apparatus includes: an ejector configured to eject a liquid; a housing including a tank storage portion in which is stored a tank for accommodating a liquid to be supplied to the ejector, the housing having an opening through which the tank storage portion and an exterior of the housing communicate with each other; a lid attached to the housing and configured to be selectively positioned at one of a closed position at which the opening is closed and an open position at which the opening is opened; and an operation panel including an operating portion which is provided for at least one of a front surface and an upper surface of the housing and which is to be externally operated, wherein the lid is attached to the housing so as to be slidable in an up-down direction with respect to the housing, the lid being positioned at the open position by sliding upward from the closed position.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF THE EMBODIMENTS

First Embodiment

Figure 1:
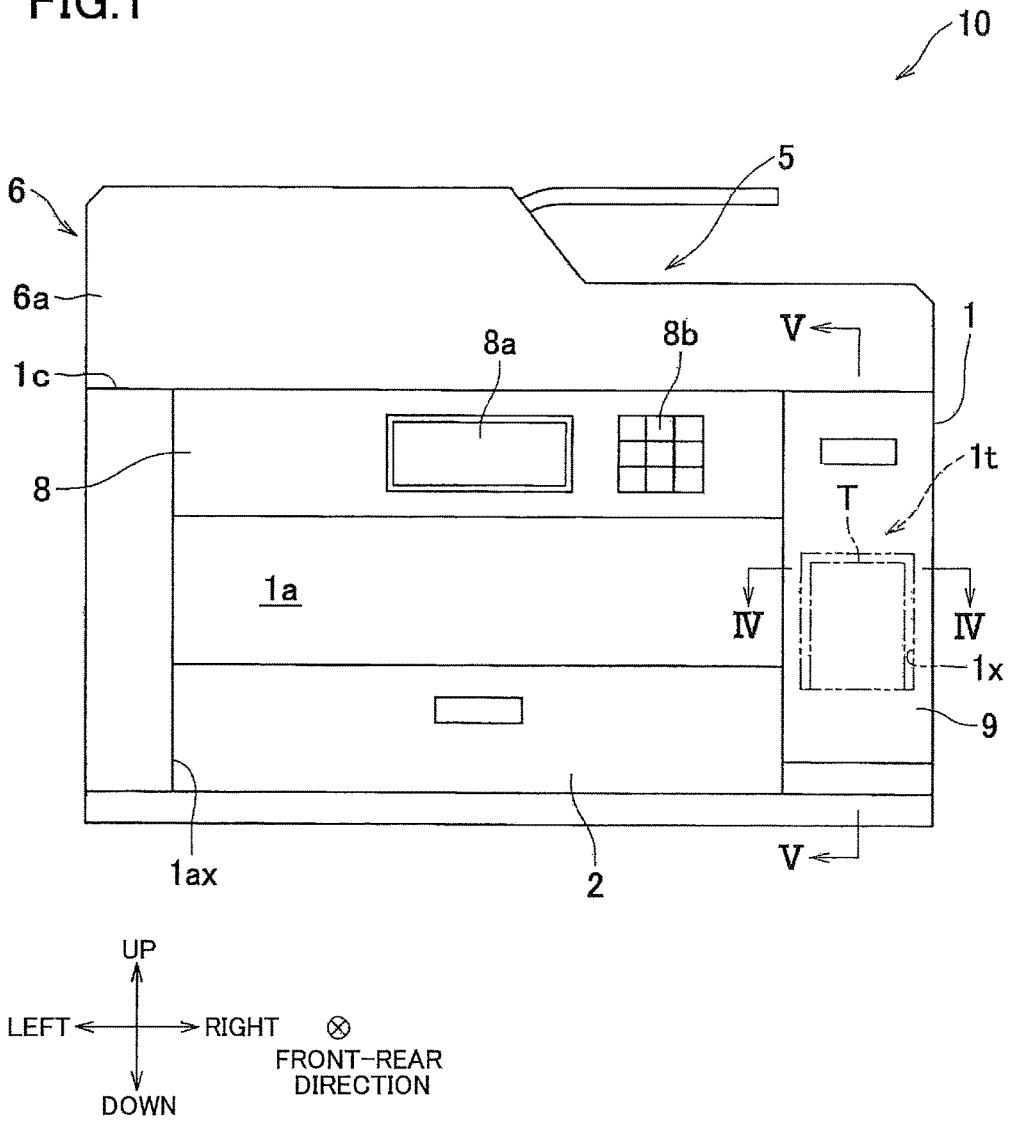
FIG. 1 is a front view of a printer according to a first embodiment.
Figure 2:
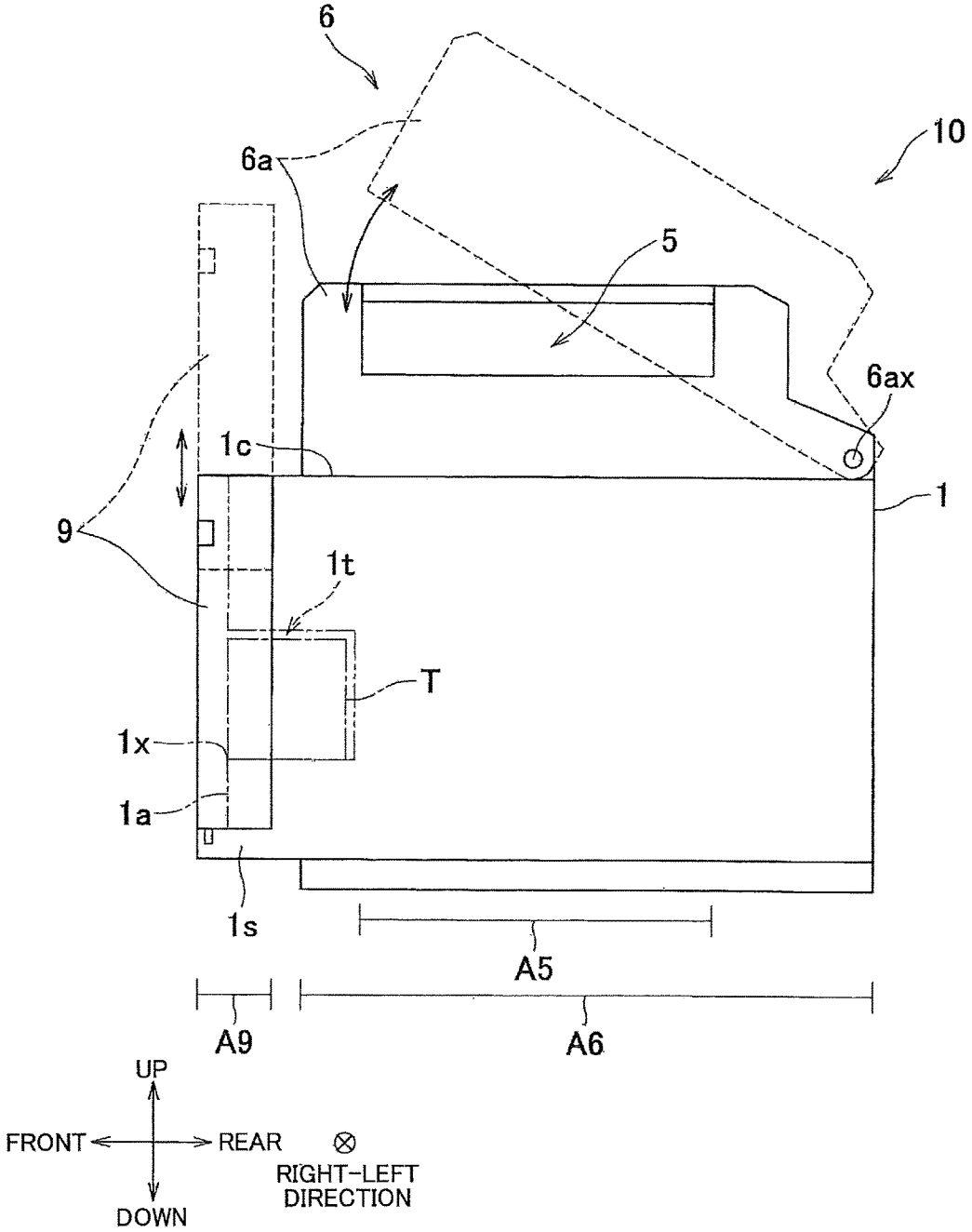
FIG. 2 is a side view of the printer according to the first embodiment.
Figure 3:
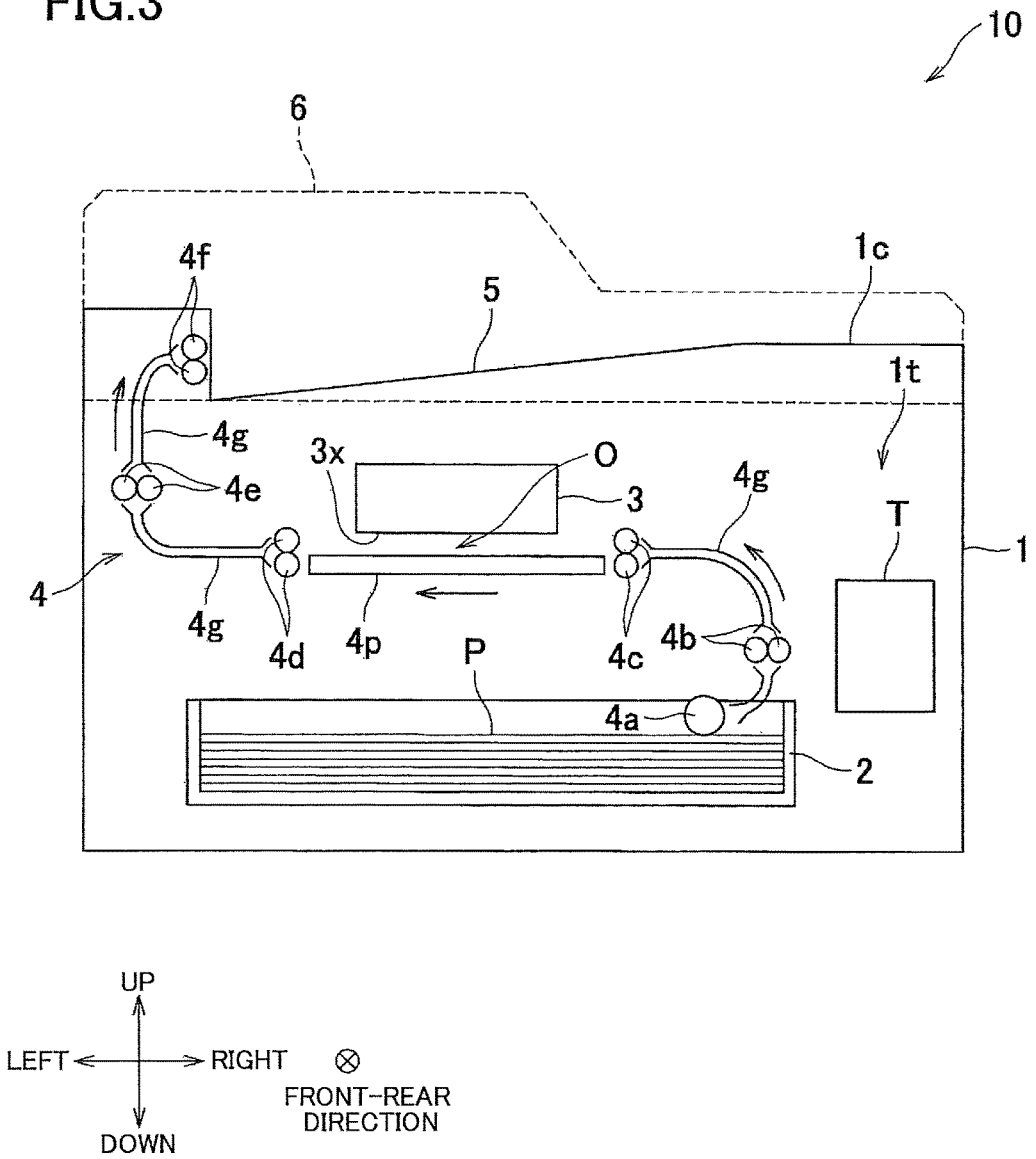
FIG. 3 is a front view showing an interior of the printer according to the first embodiment.

As shown in FIGS. 1-3, a printer 10 according to a first embodiment of the present disclosure includes a housing 1 shaped like a rectangular parallelepiped.

As shown in FIG. 1, there is formed, in a front surface 1*a* of the housing 1, an opening lax through which a sheet storage 2 is mounted. The sheet storage 2 is mountable on and removable from the housing 1. The sheet storage 2 is inserted into the housing 1 through the opening lax. As shown in FIG. 3, the sheet storage 2 stores a stack of a plurality of sheets P.

As shown in FIG. 3, there are housed, in the housing 1, an ejector 3 for ejecting ink, a conveyor 4 for conveying the sheets P, and a tank storage portion 1*t*. A tank T accommodating ink is stored in the tank storage portion 1*t*. A sheet receiver 5 (as one example of "receiver") for receiving the sheets P is provided on an upper surface 1*c* of the housing 1.

The ejector 3 is held in communication with the tank T. The ejector 3 is configured to eject, from a plurality of ejection openings (not shown), the ink supplied from the tank T. The ejector 3 includes an ejection surface 3*x* in which the plurality of ejection openings are open.

The conveyor 4 includes a roller 4*a* disposed so as to contact an uppermost one of the sheets P stored in the sheet storage 2, a plurality of roller pairs 4*b*-4*f* disposed along a conveyance path so as to be spaced apart from each other, a platen 4*p* opposed to the ejection surface 3*x*, and guide plates 4*g* which define the conveyance path. The conveyor 4 is configured to convey the uppermost one of the plurality of sheets P stored in the sheet storage 2 such that the uppermost sheet P passes a facing position O at which the uppermost sheet P faces the ejection surface 3*x*.

The sheet receiver 5 is configured to receive the sheet P that has been conveyed by the conveyor 4 and has passed the facing position O, i.e., the sheet P having a surface on which ink has been ejected and recording has been performed.

As shown in FIG. 1, an operation panel 8 is provided on the front surface 1*a* of the housing 1. The operation panel 8 includes a touch panel display 8*a* and a keyboard 8*b*. A user of the printer 10 can operate the touch panel display 8*a* and the keyboard 8*b* on the front side of the housing 1. The touch panel display 8*a* and the keyboard 8*b* correspond to an operating portion to be externally operated. The touch panel display 8*a* and the keyboard 8*b* are disposed so as to be oriented in a normal (right) direction when viewed from the front side of the housing 1, namely, the touch panel display 8*a* and the keyboard 8*b* are disposed such that a front face of the touch panel display 8*a* can be seen when viewed from the front side of the housing 1. In other words, the touch panel display 8*a* and the keyboard 8*b* are disposed such that the user can recognize that symbols such as characters displayed on the touch panel display 8*a* and the keyboard 8*b* are oriented in a proper direction.

Figure 4:
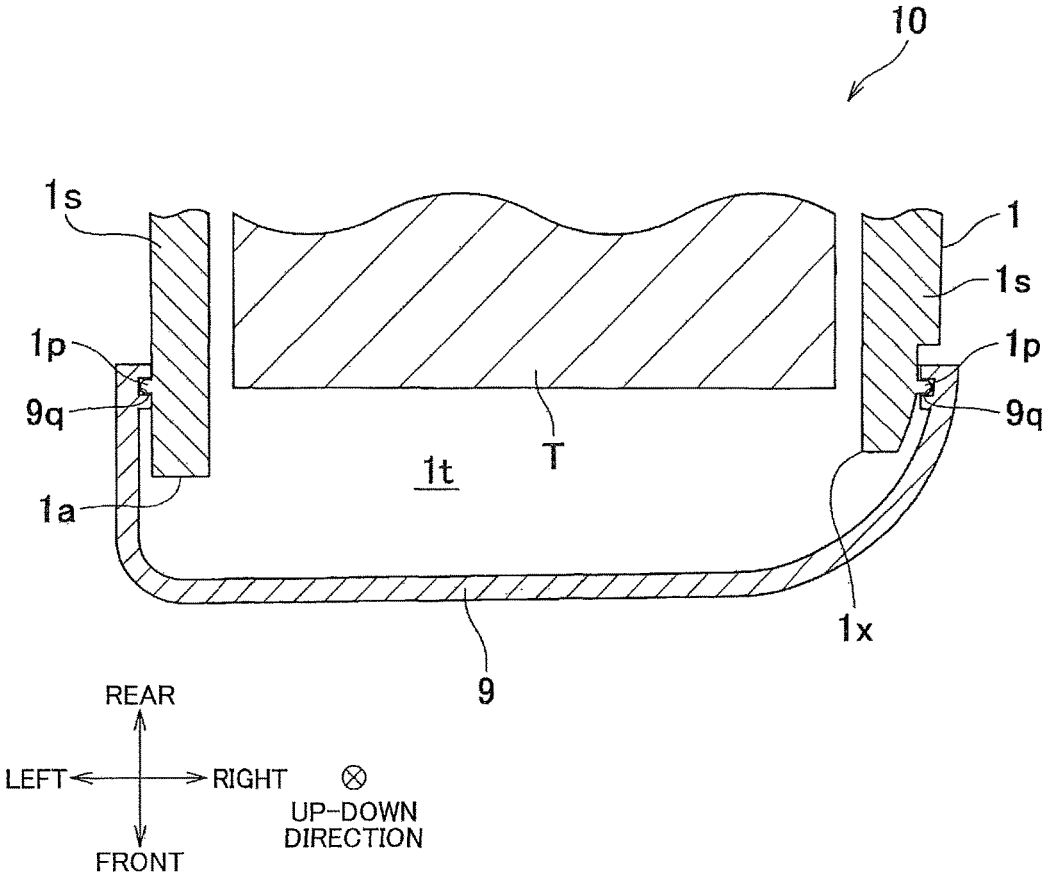
FIG. 4 is a cross-sectional view taken along line IV-IV in FIG. 1.

As shown in FIGS. 2 and 4, the housing 1 includes a protruding portion 1*s* that partially defines the tank storage portion 1*t*. The protruding portion 1*s* protrudes more frontward than other portion of the housing 1 except the protruding portion 1*s*. In other words, as shown in FIG. 4, side surfaces of the tank storage portion 1*t* in a right-left direction are defined by side portions of the protruding portion 1*s* that protrudes frontward. As shown in FIG. 2, an upper portion of the protruding portion 1*s* located over the tank storage portion 1*t* defines an upper surface of the tank storage portion 1*t*, and a lower portion of the protruding portion 1*s* located under the tank storage portion 1*t* defines a lower surface of the tank storage portion 1*t*. Thus, the protruding portion 1*s* protrudes toward the front side of the housing 1 more frontward than other portion of the housing 1 except the protruding portion 1*s*, so as to define a part of the tank storage portion 1*t*.

Figure 5:
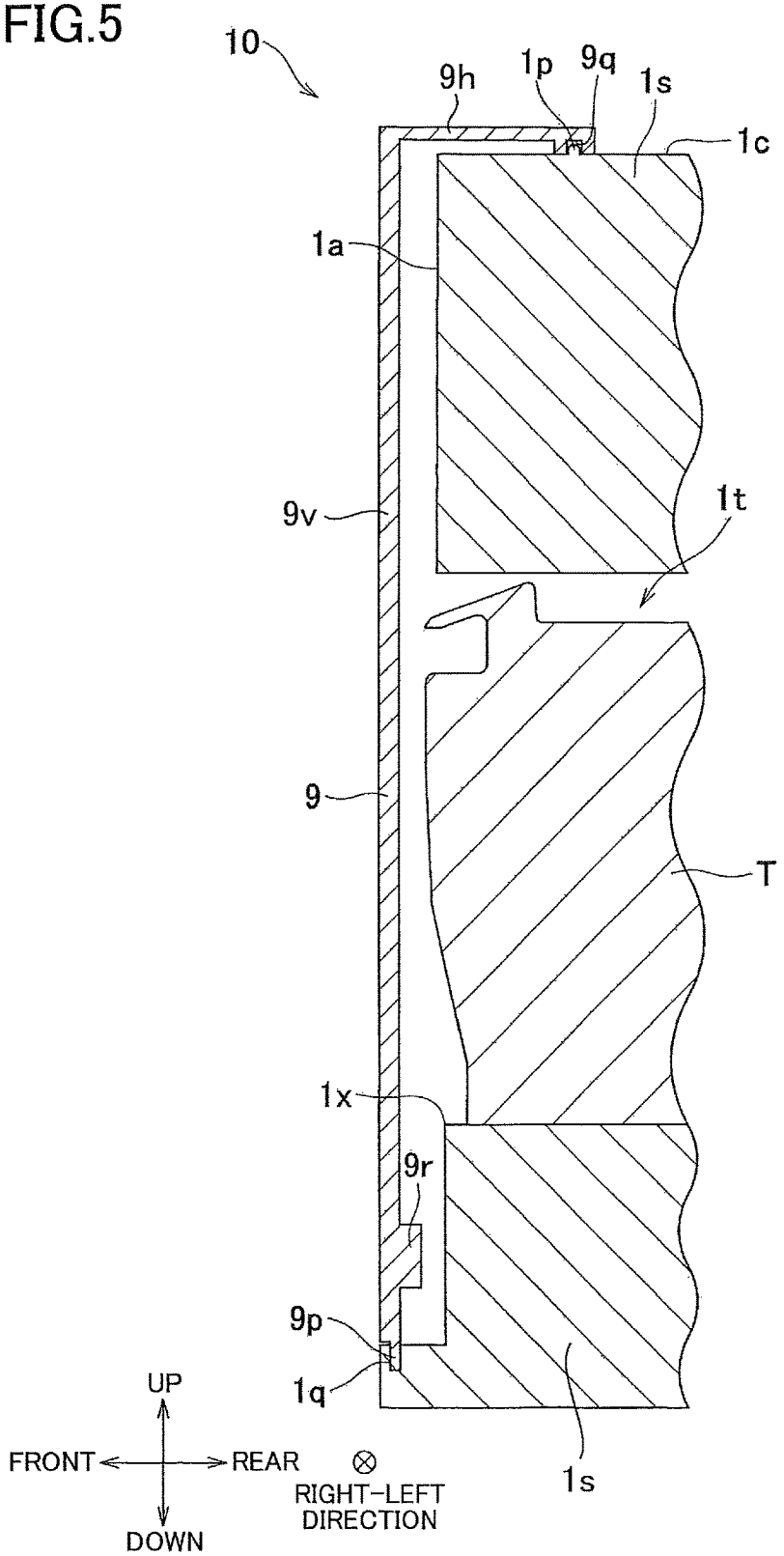
FIG. 5 is a cross-sectional view taken along line V-V in FIG. 1.

An opening 1*x* is formed in a front surface of the protruding portion 1*s* for communication between the tank storage portion 1*t* and an exterior of the housing 1. A lid 9 is attached to the housing 1. The lid 9 is configured to be selectively positioned at one of a closed position (indicated by the solid line in FIG. 2) at which the opening 1*x* is closed by the lid 9 and an open position (indicated by the dashed line in FIG. 2) at which the opening 1*x* is open. The lid 9 is slidable in an up-down direction with respect to the housing 1 and is positioned at the open position by sliding upward from the closed position. The lid 9 includes vertical portions 9*v* extending in the up-down direction (the vertical direction) and a horizontal portion 9*h* extending from upper ends of the vertical portions in the right-left direction (the horizontal direction). As shown in FIG. 5, the lid 9 is disposed such that the horizontal portion 9*h* covers, namely, overlaps, the upper surface 1*c* of the protruding portion 1*s* of the housing 1 when viewed from above in the up-down direction.

As shown in FIG. 1, a scanner 6 is provided on the upper surface 1*c* of the housing 1. The scanner 6 corresponds to an image reader for reading an image formed on the sheet P. As shown in FIG. 2, a cover 6*a* of the scanner 6 is pivotable about a shaft 6*ax* extending in the horizontal direction (the right-left direction). That is, the cover 6*a* (as one example of "pivotal member") is pivotably attached to the housing 1.

As indicated by the dashed line in FIG. 2, an upper limit position in an area of the sliding movement of the lid 9 is located at a height level lower than a height level of an upper limit position in an area of the pivotal movement of the cover 6*a*. Further, a projective region A9 formed by projecting the lid 9 in the up-down direction onto an imaginary plane orthogonal to the up-down direction does not overlap any of a projective region A5 formed by projecting the sheet receiver 5 in the up-down direction onto the imaginary plane and a projective region A6 formed by projecting the scanner 6 in the up-down direction onto the imaginary plane.

As shown in FIGS. 4 and 5, the housing 1 includes a protrusion 1*p* and a recess 1*q*, and the lid 9 includes a protrusion 9*p* and a recess 9*q*.

The protrusion 1*p* includes: portions extending in the up-down direction on respective side surfaces of the protruding portion 1*s*; and a portion extending in the right-left direction on the upper surface 1*c* of the protruding portion 1*s*. These portions are connected so as to be integral to each other. The recess 9*q* includes: portions extending in the up-down direction on inner surfaces of respective side portions of the lid 9; and a portion extending in the right-left direction on an inner surface of an upper portion of the lid 9. These portions are connected so as to be integral to each other. When the lid 9 is positioned at the closed position, the protrusion 1*p* is fitted in the recess 9*q*.

The protrusion 9*p* extends along a lower edge of the lid 9, namely, a portion extending in the right-left direction and portions extending in the front-rear direction on a lower surface of a lower portion of the lid 9 are connected. The recess 1*q* is provided at a portion of a lower end of the protruding portion 1*s* which is opposed to the lower edge of the lid 9. When the lid 9 is positioned at the closed position, the protrusion 9*p* is fitted in the recess 1*q*.

The protrusion 1*p* and the recess 1*q* are formed so as to extend over an entire periphery of the opening 1*x*. In the protrusion 1*p*, the portions extending in the up-down direction on the respective side surfaces of the protruding portion 1*s* and the portion extending in the right-left direction on the upper surface 1*c* of the upper portion of the protruding portion 1*s* are connected. In the recess 1*q*, a portion extending in the right-left direction and portions extending in the front-rear direction on an upper surface of the lower portion of the protruding portion 1*s* are connected. Opposite ends of the protrusion 1*p* and opposite ends of the recess 1*q* are disposed without being spaced from each other, so that the protrusion 1*p* and the recess 1*q* are formed so as to extend over the entire periphery of the opening 1*x*. Similarly, the protrusion 9*p* and the recess 9*q* are formed so as to extend over the entire periphery of the opening 1*x*. In the recess 9*q*, the portions extending in the up-down direction on the inner surfaces of the respective side portions of the lid 9 and the portion extending in the right-left direction on the inner surface of the upper portion of the lid 9 are connected. In the protrusion 9*p*, the portion extending in the right-left direction and the portions extending in the front-rear direction on the lower surface of the lower portion of the lid 9 are connected. Opposite ends of the recess 9*q* and opposite ends of the protrusion 9*p* are disposed without being spaced from each other, so that the protrusion 9*p* and the recess 9*q* are formed so as to extend over the entire periphery of the opening 1*x*. In the configuration, when the lid 9 is positioned at the closed position, the protrusion 1*p* and the recess 9*q* engage with each other and the protrusion 9*p* and the recess 1*q* engage with each other, so that the opening 1*x* is hermetically closed or sealed.

Figure 6:
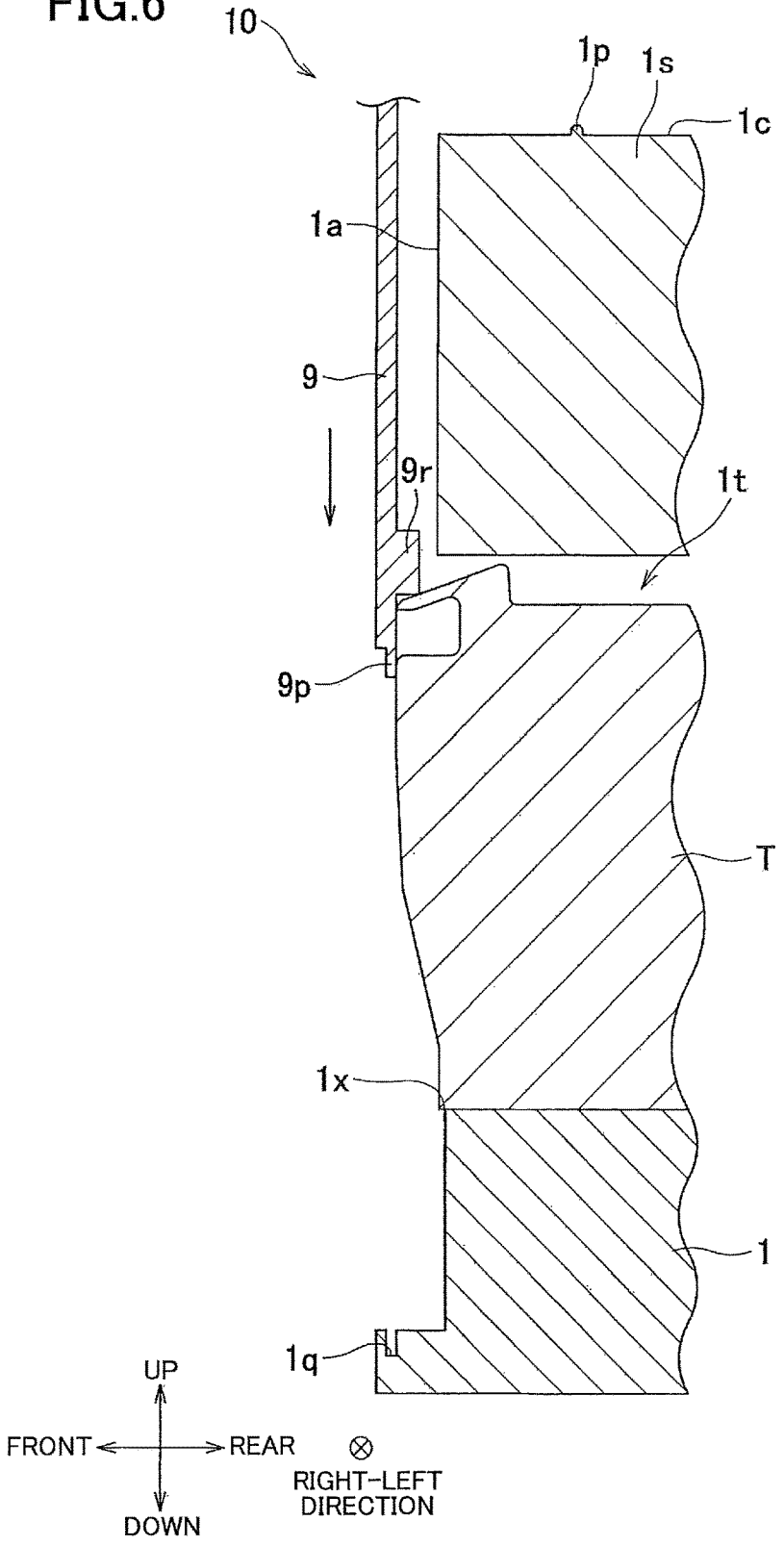
FIG. 6 is a cross-sectional view corresponding to FIG. 5, the view showing a state in which a lid contacts a tank positioned at the non-stored position when the lid slides downward.

The tank T is a cartridge type. The tank T is selectively positioned at one of a stored position (shown in FIG. 5) at which the tank T is stored in the tank storage portion 1*t* and a non-stored position (shown in FIG. 6) which is more frontward than the stored position. When the tank T is positioned at the non-stored position, not the entirety of the tank T but a part of the tank T is inserted in the tank storage portion 1*t*, as shown in FIG. 6. In other words, the non-stored position is a position of the tank T at which a part of the tank T is inserted in the tank storage portion 1*t* and at which the tank T is positioned more frontward than when positioned at the stored position.

A projection 9*r* (as one example of "contact portion") is provided on an inner surface of a lower end portion of the lid 9. Specifically, the projection 9*r* is provided at a position of a rear surface of the lid 9 at which the projection 9*r* can face a front surface of the tank T stored in the tank storage portion 1*t*. The projection 9*r* is formed so as to be spaced upward from the protrusion 9*p* formed at the lower end of the lid 9. When the lid 9 slides from the open position toward the closed position, the projection 9*r* does not come into contact with the tank T positioned at the stored position, as shown in FIG. 5. That is, the projection 9*r* protrudes rearward from the rear surface of the lid 9 such that a rear end of the projection 9*r* is spaced apart from the front surface of the tank T positioned at the stored position, by a predetermined distance. Further, when the lid 9 slides downward from the open position toward the closed position, the projection 9*r* comes into contact with the tank T positioned at the non-stored position, as shown in FIG. 6. That is, when the lid 9 slides downward from the open position toward the closed position in a state in which the tank T is not appropriately stored in the tank storage portion 1*t* and is positioned at the non-stored position as shown in FIG. 6, the projection 9*r* comes into contact with the tank T, so that the lid 9 cannot reach the closed position. In this instance, an upper end portion of the opening 1*x* is covered with the lower end portion of the lid 9, but a substantial portion of the opening 1*x* except for the upper end portion thereof is not covered with the lid 9.

According to the present embodiment, the tank storage portion 1*t* protrudes frontward, and the lid 9 is configured to be slidable in the up-down direction with respect to the housing 1. Thus, the lid 9 is unlikely to be damaged, and the housing 1 is unlikely to topple over. In general, the printer 10 has an enough space on its front side and an enough space on its upper side. It is thus possible to solve the problem of the installation space utilizing such a front space and an upper space of the printer 10.

The sheet receiver 5 is provided on the upper surface 1*c* of the housing 1, and the projective regions A5, A9 do not overlap each other, as shown in FIG. 2. In this configuration, when the lid 9 slides in the up-down direction with respect to the housing 1, the lid 9 does not come into contact with the sheet receiver 5. It is thus possible to obviate the risk of damage to the lid 9 due to contact with the sheet receiver 5.

The scanner 6 is provided on the upper surface 1*c* of the housing 1, and the projective regions A6, A9 do not overlap each other, as shown in FIG. 2. In this configuration, when the lid 9 slides in the up-down direction with respect to the housing 1, the lid 9 does not come into contact with the scanner 6. It is thus possible to obviate the risk of damage to the lid 9 due to contact with the scanner 6.

The upper limit position in the area of the sliding movement of the lid 9 is located at a height level equal to or lower than a height level of the upper limit position in the area of the pivotal movement of the cover 6*a* (FIG. 2). This configuration eliminates a need to provide a space on the upper side of the printer 10 for the sliding movement of the lid 9.

The projection 9*r* is configured to come into contact with the tank T positioned at the non-stored position, so as to prevent the lid 9 from reaching the closed position (FIG. 6). In this configuration, the user recognizes that the tank T is not appropriately stored because of the lid 9 which is prevented from reaching the closed position.

When the projection 9*r* contacts the tank T positioned at the non-stored position, a part of the opening 1*x* is not covered with the lid 9 (FIG. 6). In this configuration, the user sees the part of the opening 1*x* and accordingly can recognize that the tank T is not appropriately stored in the tank storage portion 1*t*.

The printer 10 includes an engagement portion (the protrusion 1*p* and the recess 1*q* of the housing 1 and the protrusion 9*p* and the recess 9*q* of the lid 9) configured to bring the housing 1 and the lid 9 into engagement for hermetically sealing the opening 1*x* when the lid 9 is positioned at the closed position. This configuration prevents entry of dust into the tank storage portion 1*t* through the opening 1*x*.

The engagement portion includes the protrusion 1*p* and the recess 1*q* of the housing 1 and the protrusion 9*p* and the recess 9*q* of the lid 9. The protrusion 1*p* and the recess 1*q* are formed over the entire periphery of the opening 1*x*. Similarly, the protrusion 9*p* and the recess 9*q* are formed over the entire periphery of the opening 1*x*. This configuration prevents entry of dust into the tank storage portion 1*t* through the opening 1*x* with higher stability.

Second Embodiment

A printer 210 according to a second embodiment of the present disclosure differs from the printer 10 of the first embodiment in the structure of the tank T. The printer 210 is identical to the printer 10 in other configuration.

Figure 7:
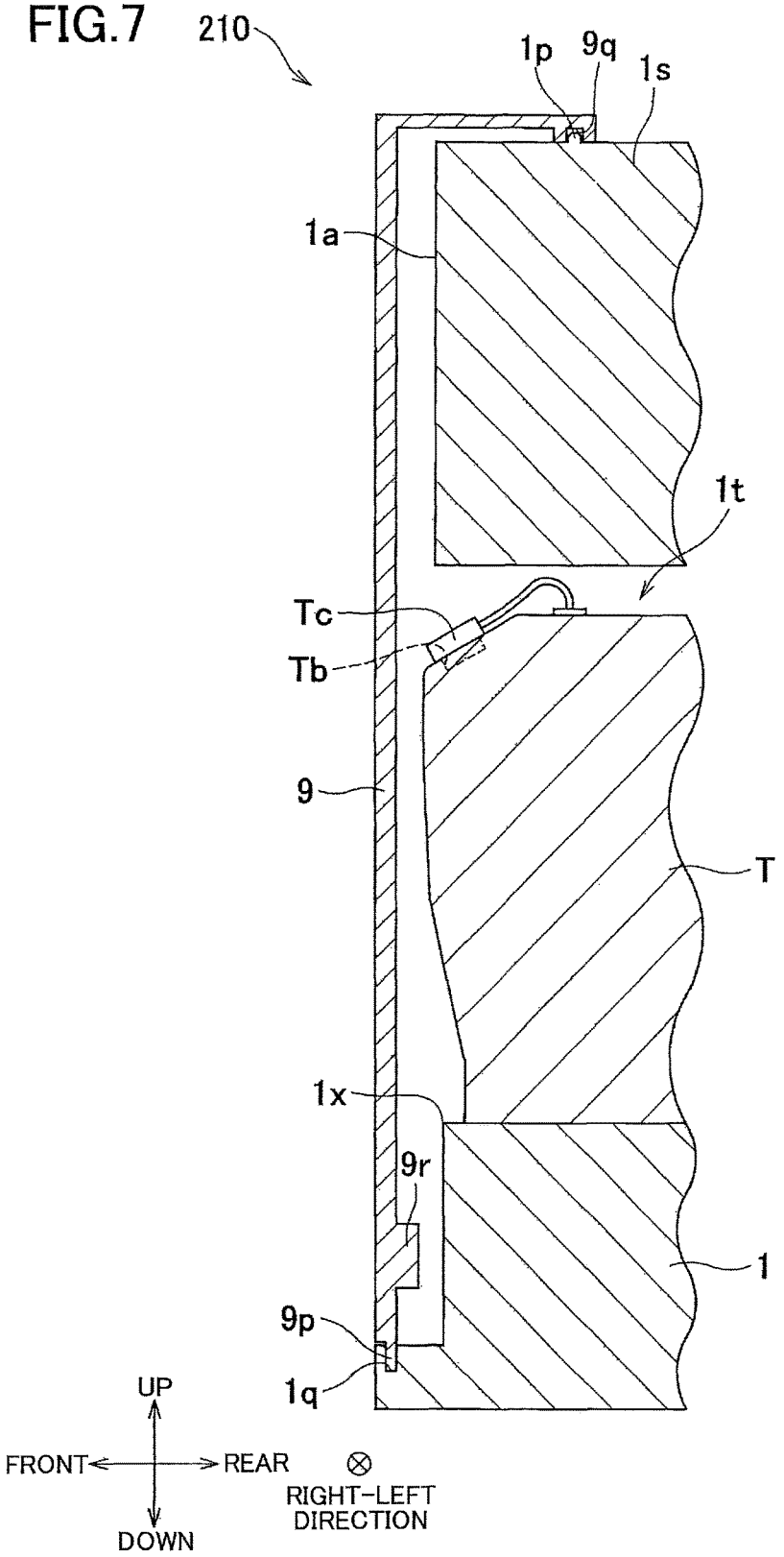
FIG. 7 is a cross-sectional view corresponding to FIG. 5, the view showing a printer according to a second embodiment.
Figure 8:
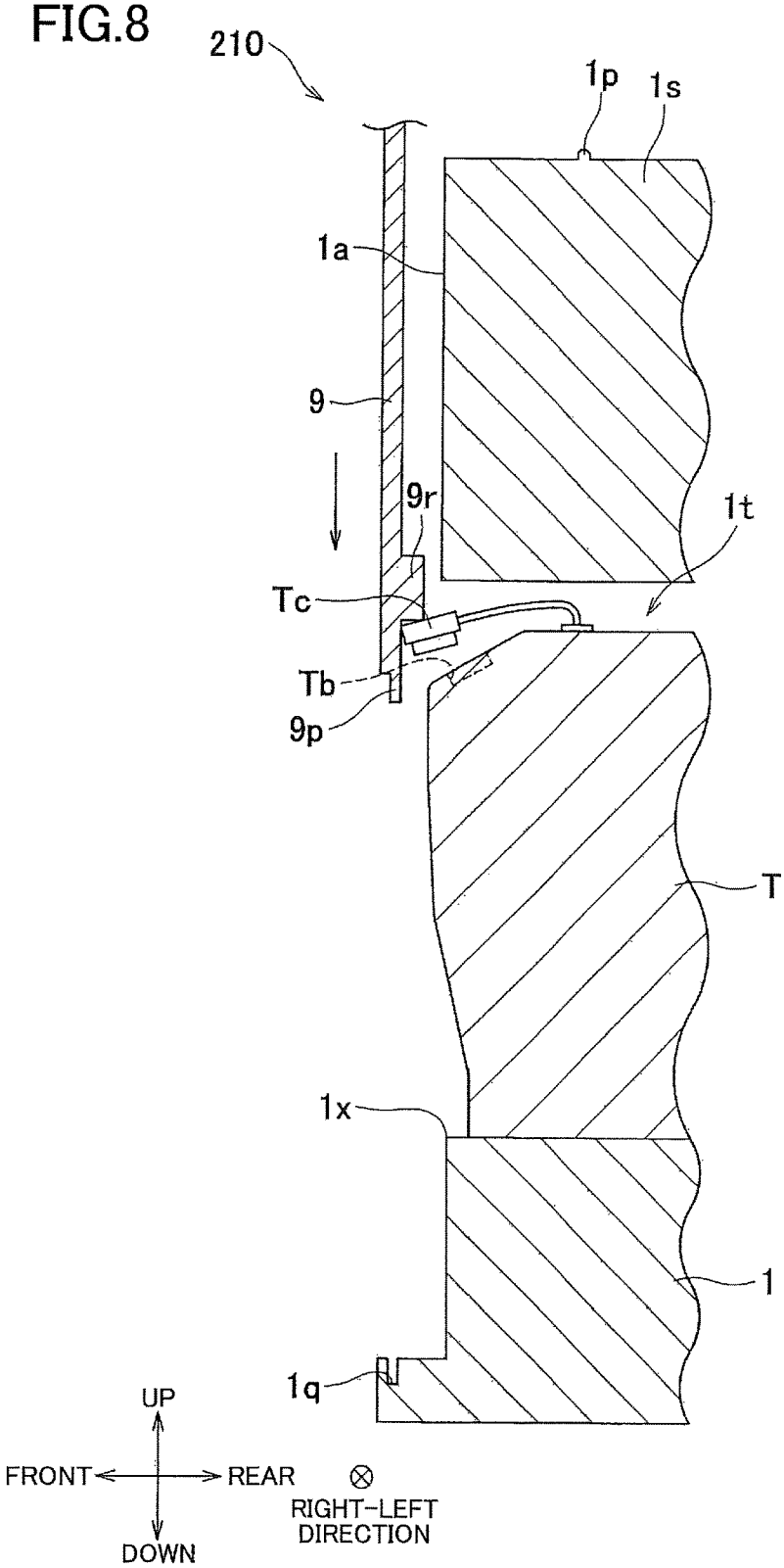
FIG. 8 is a cross-sectional view corresponding to FIG. 7, the view showing a state in which the lid contacts a plug positioned at a non-sealing position when the lid slides downward.
Figure 9:
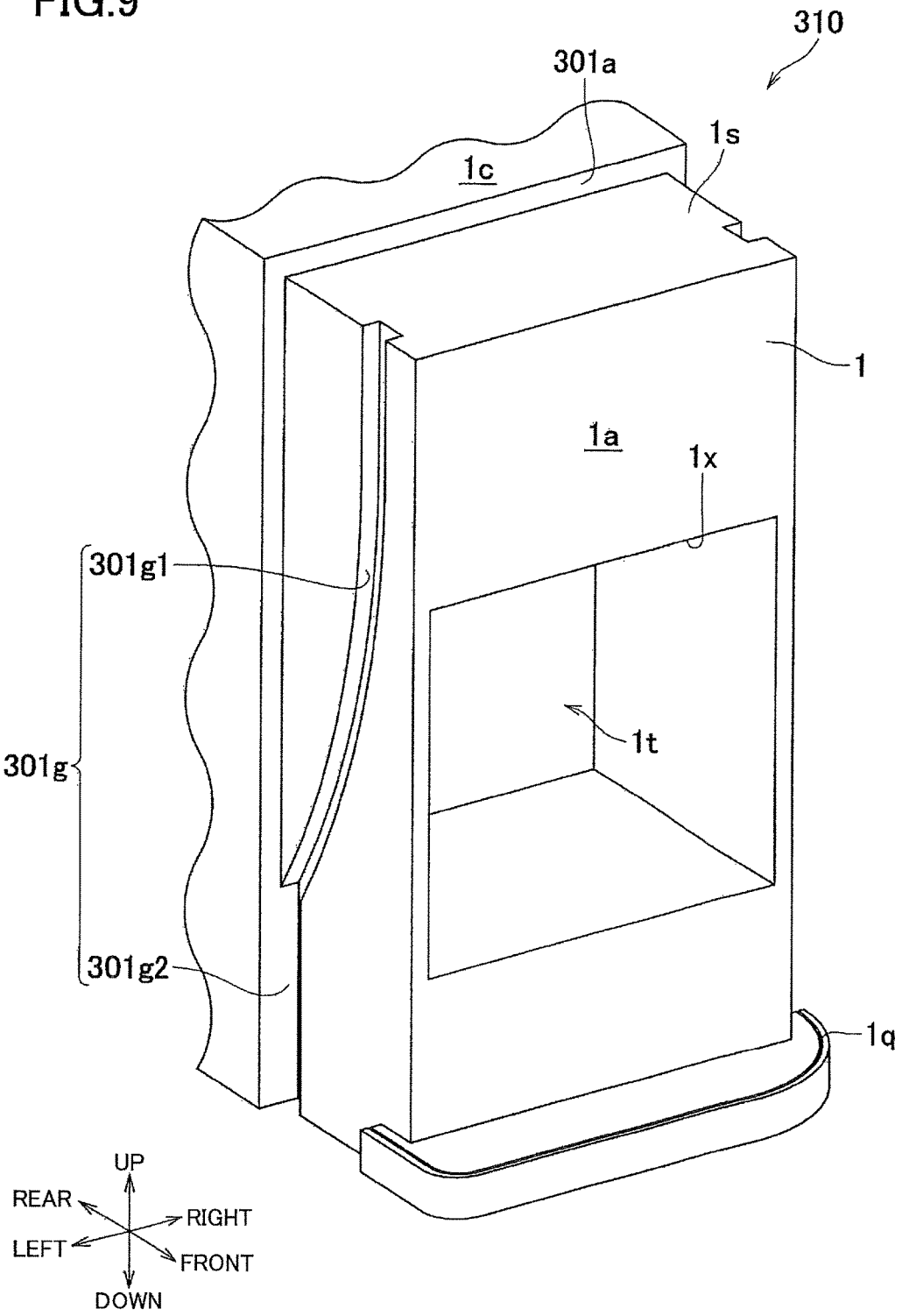
FIG. 9 is a perspective view showing a portion of a housing of a printer according to a third embodiment, the portion being in the vicinity of a tank storage portion.
Figure 10:
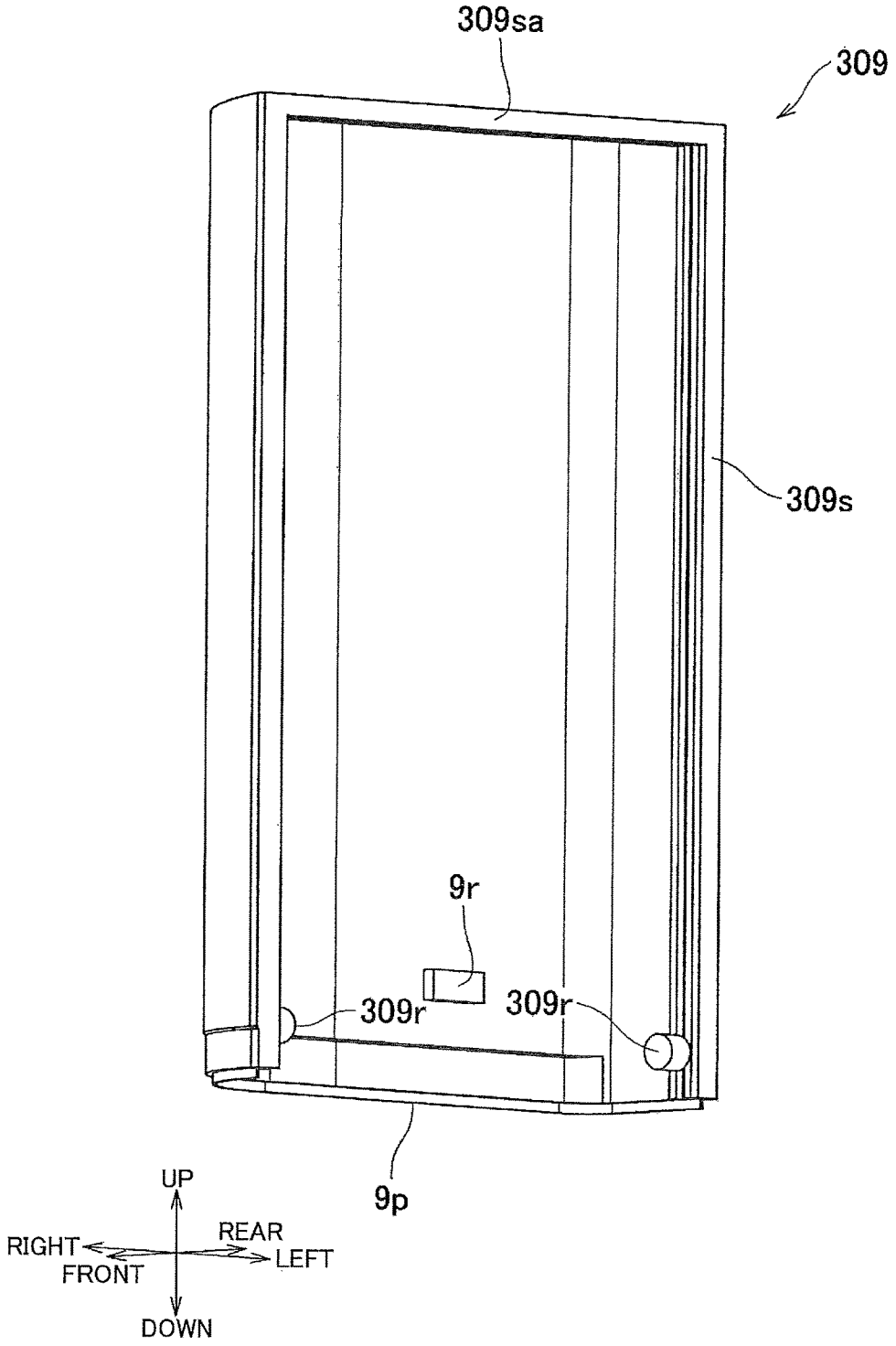
FIG. 10 is a perspective view showing a lid of the printer according to the third embodiment.

As shown in FIGS. 7 and 8, the tank T of the present embodiment is an ink refill type, instead of the cartridge type. The tank T is disposed at a predetermined fixed position in the tank storage portion 1*t*. The tank T includes a refill opening Tb for refilling the tank T with ink and a plug Tc configured to be selectively positioned at one of a sealing position (shown in FIG. 7) at which the plug Tc hermetically seals or closes the refill opening Tb and a non-sealing position (shown in FIG. 8) at which the plug Tc does not hermetically seal or close the refill opening Tb. The refill opening Tb and the plug Tc are provided at a front end portion of the tank T.

When the lid 9 slides downward from the open position toward the closed position, the projection 9*r* does not come into contact with the plug Tc positioned at the sealing position as shown in FIG. 7 but comes into contact with the plug Tc positioned at the non-sealing position as shown in FIG. 8. That is, as shown in FIG. 8, when the lid 9 slides downward from the open position toward the closed position in a case where the plug Tc is not appropriately attached to the refill opening Tb, the projection 9*r* comes into contact with the plug Tc, preventing the lid 9 from reaching the closed position. In this instance, the upper end portion of the opening 1*x* is covered with the lower end portion of the lid 9, but a substantial portion of the opening 1*x* except the upper end portion thereof is not covered with the lid 9.

According to the present embodiment, the lid 9 is prevented from reaching the closed position by contact of the projection 9*r* with the plug Tc positioned at the non-sealing position. In this configuration, the user recognizes that the refill opening Tb is not hermetically sealed because of the lid 9 which is prevented from reaching the closed position.

Third Embodiment

A printer 310 according to a third embodiment of the present disclosure differs from the printer 10 of the first embodiment in the structure of the engagement portion. The printer 310 is identical to the printer 10 of the first embodiment in other configuration.

In this third embodiment, the recess 1*q* and the protrusion 9*p* are provided as in the first embodiment, but the protrusion 1*p* and the recess 9*q* are not provided.

A guide groove 301*g* is formed in each of side surfaces of the protruding portion 1*s*. The guide groove 301*g* includes a curved groove 301*g*1 and a vertical groove 301*g*2. The curved groove 301*g*1 extends from the upper end of the protruding portion 1*s* downward and rearward so as to be curved. The vertical groove 301*g*2 extends in the vertical direction from a lower end of the curved groove 301*g*1 toward the lower end of the protruding portion 1*s*.

A guide rib 309*r* is provided on an inner surface of each of side portions of the lid 309. The guide rib 309*r* protrudes inward from the inner surface and is configured to be inserted in the corresponding guide groove 301*g*. The guide grooves 301*g* are provided at a portion of the protruding portion 1*s*, which portion is located at opposite sides of the opening 1*x*, and the guide ribs 309*r* are provided at a portion of the lid 309, which portion is located at opposite sides of the opening 1*x*.

An elastic member 309*s* formed of a sponge or the like is provided on end faces of the side portions of the lid 309 and an end face of the upper portion of the lid 309.

When the lid 309 is moved downward with the guide ribs 309*r* inserted in upper ends of the respective curved grooves 301*g*1, the lid 309 is guided downward and rearward along the curved grooves 301*g*1. That is, when the lid 309 is moved from the open position toward the closed position, the guide grooves 301*g* and the guide ribs 309*r* cooperate to guide the lid 309 rearward. At the same time when the lid 309 reaches the closed position, an end face 309*sa* of the elastic member 309*s* is brought into a pressing contact with a press contact surface 301*a* of the housing 1. In this instance, the elastic member 309*s* is nipped by and between the housing 1 and the lid 309.

According to the third embodiment, the engagement portion includes the guide grooves 301*g* for guiding the lid 309 rearward when the lid 309 moves from the open position toward the closed position, the guide ribs 309*r* inserted into the respective guide grooves 309*g*, and the elastic member 309*s* nipped by and between the housing 1 and the lid 309 positioned at the closed position. This configuration prevents entry of dust into the tank storage portion 1*t* through the opening 1*x* with higher reliability.

While the embodiments of the disclosure have been described above, it is to be understood that the disclosure is not limited to the details of the illustrated embodiments, but may be embodied with other various changes and modifications, which may occur to those skilled in the art, without departing from the scope of the disclosure.

Modifications

The operation panel may be provided on the upper surface of the housing or may be provided on both of the front surface and the upper surface of the housing. Also in a case where the operation panel is provided on the upper surface of the housing, the operating portion is disposed so as to be oriented in a normal (right) direction when viewed from the front side of the housing, namely, the operating portion is disposed such that the user can recognize that symbols such as characters displayed on the operating portion (the touch panel display and the keyboard) are oriented in a proper direction. The operating portion is not limited to the touch panel display and the keyboard, but may be buttons and the like.

The engagement portion may be omitted.

In the illustrated embodiments, the contact portion is provided on the inner surface of the lower end portion of the lid. The present disclosure is not limited to this configuration. For instance, the contact portion may be provided at a suitable portion of the lid such as the inner surface of the upper end portion of the lid. When the contact portion contacts the tank positioned at the non-stored position, the entirety of the opening may be covered with the lid.

The ejector may be any of a line-type and a serial type. The liquid ejected by the ejector is not limited to ink, but may be any liquid (such as a treatment liquid for causing coagulation or precipitation of a component in ink).

The recording medium is not limited to the sheet, but may be any recordable medium such as a cloth. The present disclosure is applicable not only to the printer, but also to a facsimile, a copying machine, a multi-function peripheral (MFP) and the like.

What is claimed is:

1. A liquid ejection apparatus, comprising:

an ejector configured to eject a liquid;

a housing including a tank storage portion in which is stored a tank for accommodating a liquid to be supplied to the ejector, the housing having an opening through which the tank storage portion and an exterior of the housing communicate with each other;

a lid attached to the housing and configured to be selectively positioned at one of a closed position at which the opening is closed and an open position at which the opening is opened; and an operation panel including an operating portion which is provided for at least one of a front surface and an upper surface of the housing and which is to be externally operated, wherein the lid is attached to the housing so as to be slidable in an up-down direction with respect to the housing, the lid being positioned at the open position by sliding upward from the closed position, wherein the housing includes a protruding portion that protrudes more frontward than a portion of the housing other than the protruding portion, and wherein a part of the tank storage portion is defined by the protruding portion.

2. The liquid ejection apparatus according to claim 1, further comprising: a conveyor configured to convey a recording medium such that the recording medium passes a facing position at which the recording medium faces the ejector; and a receiver configured to receive the recording medium that has been conveyed by the conveyor so as to pass the facing position, wherein the receiver is provided on an upper surface of the housing, and wherein a projective region formed by projecting the receiver in the up-down direction onto an imaginary plane orthogonal to the up-down direction and a projective region formed by projecting the lid in the up-down direction onto the imaginary plane do not overlap each other.

3. The liquid ejection apparatus according to claim 1, wherein the tank is a cartridge type, the tank being configured to be selectively positioned at one of a stored position at which the tank is stored in the tank storage portion and a non-stored position at which the tank is partially inserted in the tank storage portion and at which the tank is located more frontward than when the tank is located at the stored position, and wherein the lid includes a contact portion configured such that, when the lid slides downward from the open position to the closed position, the contact portion does not come into contact with the tank located at the stored position and comes into contact with the tank located at the non-stored position, the lid being prevented from reaching the closed position by contact of the contact portion with the tank located at the non-stored position.

4. The liquid ejection apparatus according to claim 3, wherein the contact portion is provided on a rear surface of the lid so as to face a front surface of the tank.

5. The liquid ejection apparatus according to claim 3, wherein a portion of the opening is not covered by the lid in a state in which the contact portion is in contact with the tank located at the non-stored position.

6. The liquid ejection apparatus according to claim 1, wherein the tank is a liquid refill type, the tank including a refill opening for refilling the tank with the liquid and a plug configured to be selectively positioned at one of a sealing position at which the plug hermetically seals the refill opening and a non-sealing position at which the plug does not hermetically seal the refill opening, and wherein the lid includes a contact portion configured such that, when the lid slides downward from the open position to the closed position, the contact portion does not come into contact with the plug located at the sealing position and comes into contact with the plug located at the non-sealing position, the lid being prevented from reaching the closed position by contact of the contact portion with the plug located at the non-sealing position.

7. The liquid ejection apparatus according to claim 1, further comprising an engagement portion configured to bring the housing and the lid into engagement with each other so as to hermetically seal the opening when the lid is located at the closed position, wherein the engagement portion includes:

guide grooves provided at a portion of the first member which is the one of the housing and the lid, the portion being located at opposite sides of the opening, the guide grooves being configured to guide the lid rearward when the lid slides from the open position to the closed position;

guide ribs provided at a portion of the second member which is the other of the housing and the lid, the portion being located at opposite sides of the opening, the guide ribs being configured to be inserted into the guide grooves formed at the portion of the first member; and an elastic member nipped by and between the housing and the lid located at the closed position.

8. A liquid ejection apparatus, comprising:

an ejector configured to eject a liquid;

a housing including a tank storage portion in which is stored a tank for accommodating a liquid to be supplied to the ejector, the housing having an opening through which the tank storage portion and an exterior of the housing communicate with each other;

a lid attached to the housing and configured to be selectively positioned at one of a closed position at which the opening is closed and an open position at which the opening is opened;

an operation panel including an operating portion which is provided for at least one of a front surface and an upper surface of the housing and which is to be externally operated; and an image reader configured to read an image on a recording medium, wherein the lid is attached to the housing so as to be slidable in an up-down direction with respect to the housing, the lid being positioned at the open position by sliding upward from the closed position, wherein the image reader is provided on an upper surface of the housing, and wherein a projective region formed by projecting the image reader in the up-down direction onto an imaginary plane orthogonal to the up-down direction and a projective region formed by projecting the lid in the up-down direction onto the imaginary plane do not overlap each other.

9. The liquid ejection apparatus according to claim 8, wherein the image reader includes a pivotal member configured to pivot about a shaft along a horizontal direction, and wherein a height of an upper limit position in an area of a sliding movement of the lid is not greater than a height of an upper limit position in an area of a pivotal movement of the pivotal member.

10. A liquid ejection apparatus, comprising:

an ejector configured to eject a liquid;

a housing including a tank storage portion in which is stored a tank for accommodating a liquid to be supplied to the ejector, the housing having an opening through which the tank storage portion and an exterior of the housing communicate with each other;

a lid attached to the housing and configured to be selectively positioned at one of a closed position at which the opening is closed and an open position at which the opening is opened;

an operation panel including an operating portion which is provided for at least one of a front surface and an upper surface of the housing and which is to be externally operated; and an engagement portion configured to bring the housing and the lid into engagement with each other so as to hermetically seal the opening when the lid is located at the closed position, wherein the lid is attached to the housing so as to be slidable in an up-down direction with respect to the housing, the lid being positioned at the open position by sliding upward from the closed position, wherein the engagement portion includes a recess provided for a first member which is one of the housing and the lid and a protrusion provided for a second member which is the other of the housing and the lid, and wherein the recess and the protrusion are formed so as to extend over an entire periphery of the opening.

* * * * *